United States Patent [19]

Despinoy et al.

[11] Patent Number: 4,866,840

[45] Date of Patent: Sep. 19, 1989

[54] METHOD OF CONNECTING A MINERAL-INSULATED ELECTRIC CABLE, IN PARTICULAR IN THE REACTOR BUILDING OF A NUCLEAR BOILER

[75] Inventors: Bernard Despinoy, Le Blanc Mesnil; Philippe Durand, Andilly; Jean Mouget, Guyancourt, all of France

[73] Assignee: Societe Anonyme dite : Framatome, Courbevoie, France

[21] Appl. No.: 163,510

[22] Filed: Mar. 3, 1988

[30] Foreign Application Priority Data

Mar. 3, 1987 [FR] France ..... 87 02839

[51] Int. Cl.[4] ..... H01B 13/20

[52] U.S. Cl. ..... 29/828; 29/857; 29/868; 174/35 C; 174/50.55; 174/84 R

[58] Field of Search ..... 29/828, 868, 869, 857, 29/860, 872, 858; 174/84 R, 50.55, 35 C

[56] References Cited

U.S. PATENT DOCUMENTS

| | | | |
|---|---|---|---|
| 2,393,935 | 1/1946 | Scott | 174/84 R |
| 2,636,072 | 4/1953 | Lamoureaux, Jr. | 174/50.55 X |
| 3,291,893 | 12/1966 | Aske | 174/50.55 |
| 3,467,561 | 9/1969 | Waride | 174/84 R |
| 4,375,720 | 3/1983 | Bourget | 29/869 |

FOREIGN PATENT DOCUMENTS

| | | | |
|---|---|---|---|
| 1471591 | 3/1967 | France . | |
| 18376 | 7/1979 | Japan | 29/869 |
| 1270100 | 4/1972 | United Kingdom . | |

*Primary Examiner*—Joseph M. Gorski

*Attorney, Agent, or Firm*—Sughrue, Mion, Zinn, Macpeak & Seas

[57] ABSTRACT

Since the mineral insulation (M) of the cable (C) is sensitive to moisture from which it is protected over the length of the cable by a sheath (G), the bared front length (8) of the cable core (A) is initially connected to a connection length (14) whose insulation (22) is constituted by an organic material which is insensitive to moisture. The prior connection zone is embedded in a block of resin (24) surrounded with its own sheath (26). The desired electrical connection is made to the other end (18) of said connection length inside a non-sealed box. The invention is applicable to transmitting signals even in the event of an accident to a nuclear reactor.

3 Claims, 1 Drawing Sheet

METHOD OF CONNECTING A MINERAL-INSULATED ELECTRIC CABLE, IN PARTICULAR IN THE REACTOR BUILDING OF A NUCLEAR BOILER

BACKGROUND OF THE INVENTION

In nuclear power stations, and in particular in the reactor buildings of nuclear boilers, various different types of electrical equipment are installed such as actuators, sensors, etc., which are used for monitoring the various operating parameters of the reactor and for controlling the reactor. These various sensors and actuators are designed and built to operate correctly under all operating conditions, normal or accidental, so as to enable the important parameters of the reactor and its auxiliary circuits within the confinement building to be monitored and controlled continuously.

The accidental operating conditions taken into consideration are conditions resulting from accidents selected because of their severity, such as earthquakes, and more particularly accidents which give rise to a break in the primary cooling circuit of the boiler.

The various items of electrical equipment must continue to operate during and after such conditions, i.e. they must withstand the very severe ambient conditions that then arise. They are therefore designed to withstand accidental conditions during the theoretical lifetime of a nuclear boiler, and they do indeed withstand them. However, there remains a problem at the various connection points between said equipment and the cables connecting them to the various devices which issue commands and which receive measurement signals.

These cables use divided mineral insulation, for example powered megnesia or alumina, together with stainless steel sheathing which enables them to perform their transmission function reliably even in the presence of radiation, high temperatures, and certain kinds of deformation or traction.

Such mineral insulation loses its insulating ability if it is exposed to moisture. Along the length of the cable, the mineral insulation is effectively protected from moisture by the sheath. However, this sheath is necessarily interrupted at each end of the cable in order to allow electric connections to be made to the cable. That is why, in order to avoid the risk of losing electrical insulation by ingress of moisture into the insulating layer of the cable from its ends, it is conventional to protect each exposed end. This is done by means of a protective alumina end-fitting which covers the exposed end of the insulating layer.

Further, the terminal block, i.e. the set of connection terminals to which various cables are to be connected, is disposed in a connection box which, conventionally, is made in sealed manner in order to prevent moisture from coming into contact with the terminals and thus coming into contact with the protective end fitting.

The end of the insulating layer is thus protected by two barriers: a close barrier, namely the protective end-fitting; and a more distant barrier, namely the connection box.

However, it appears, that this double protection is not as safe as could be desired.

More precisely, it has appeared that the technology usable in practice for making boxes for electrical terminals simply and cheaply does not guarantee that they will remain sealed after certain types of accident. This can be understood by considering the values assumed for certain parameters inside the reactor building after a break in the primary pipework, where such a break is considered as being the most damaging form of accident;

temperature: about 156° C.

pressure : 5.5 bars humidity : greater than 80% chemical spray: pH 9.5.

Under such accident and post-accident conditions, the sealing of connection boxes is not maintained. As a result water vapor penetrates therein under the effect of the pressure difference between the inside and the outside. This water vapor condenses inside the boxes without being able to escape, and moisture penetrates into the ends of the cables. The resulting degradation in the electrical characteristics of the cables in the vicinity of the connections then gives rise to considerable disturbances in the transmitted signals. It becomes difficult, if not totally impossible, to control the reactor after such degradation.

Comparable problems may occur in other industries, in particular in chemical works or at sea.

The aim of the present invention is to enable a mineral insulated electric cable to be connected in a simple, cheap, and safe way while retaining the insulating ability of the cable even under severe conditions which may include spraying with highly conductive water, a confined atmosphere, and large pressure differences.

SUMMARY OF THE INVENTION

The present invention provides a method of connecting a mineral-insulated electric cable, in particular in the reactor building of a nuclear boiler, said method being applicable to electrically connecting one end of a flexible cable to a connection terminal, said cable comprising:

a metal core for conducting electricity;

an electrically insulating layer surrounding said core, said layer being constituted by a divided mineral substance selected for its ability to remain insulating when subjected to service conditions which do not include moisture, the substance chosen in this way losing a substantial portion of said ability in the presence of said moisture unless protected thereagainst; and a sealed protective sheath surrounding said insulating layer and protecting it from moisture at a distance from the ends of the cable;

said method comprising the following operations:

a baring operation during which an end length of the core of the cable is bared by removing said insulating layer and said protective sheath, said length constituting an "initially bared length" extending from a rear end adjacent to the remaining insulating layer, up to a free front end;

an end protecting operation during which a rear fraction of the initially bared length is surrounded by an electrically insulating sealed protective end-fitting which extends radially as far as said protective sheath so as to limit the risk of moisture penetrating into said insulating layer; and a connecting operation during which at least a front fraction of a metal cable core is placed in a protective box containing said connection terminal and said fraction is connected to said terminal in order to provide said connection;

said method being characterized by the fact that it further comprises an operation of preparing the connection length, during which operation a connection length is prepared which itself comprises:

a metal core for conducting electricity; and a protective layer surrounding said core along a central fraction of said length, said layer being electrically insulating and proof against moisture, and terminating at a distance from the ends of the connection length in order to leave a front fraction and a rear fraction of said core free;

said method further comprising, after said baring operation and said operation of preparing the connection length, and prior to said operation of protecting the end, a prior connection operation during which the front end of said initially bared length is fixed and connected to said rear fraction of the core of said connection length;

said protective end-fitting comprising a block of resin which is solidified inside a sealed connection sheath during said end protection operation, said block extending radially beyond said protective sheath and said protective layer and extending longitudinally from a point on a non-bared length of the cable up to a point on said protective layer on the connection length, and surrounding along said length the protective sheath and the initially bared length of said cable and the rear fraction and the protective layer of said connection length;

said front fraction of the connection length core being connected and fixed to said connection terminal during said connection operation.

Preferably said connection box includes openings in order to equalize pressure between the inside and the outside thereof and/or to allow moisture to escape.

Preferbly the resistivity of said metal core is below 20 ohm.cm and in most cases below 4 ohm.cm.

Under certain conditions said protective sheath of the cable and said connection sheath are made of metal and constitute electrical shielding for forming a coaxial structure for transmitting electrical signals, the walls of said box being likewise conductive in order to provide shielding. In which case, the wall of said box preferably has said connection sheath passing therethrough and is fixed to said sheath, with electrical connections being provided between said wall, said sheath and said protective sheath of the cable.

There follows a more detailed description below, by way of non-limiting example, of how the present invention may be implemented, and made with reference to the accompanying diagrammatic figures. When the same item appears in several of the figures, it is designated by the same reference symbol in all of them.

The implementation described includes the dispositions mentioned above as being the preferred dispositions in accordance with the invention. However, it must be understood that the items mentioned may be replaced by other items that provide the same technical functions.

DESCRIPTION OF THE PREFERRED EMBODIMENT

Figure 1:
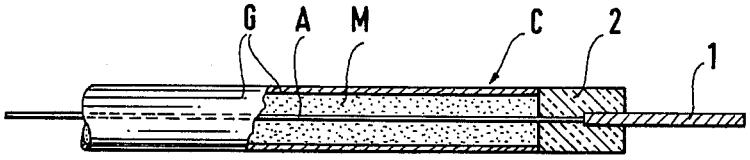
FIG. 1 is an axial section through an electric cable prepared for connection according to the above-mentioned prior art method.

In FIG. 1, a cable C has a core A and a mineral insulating layer M covered by a stainless steel sheath G. The cable core has been bared and provided with reinforcement 1 so as to be suitable for connection to the terminal strips of a terminal block. A protective alumina end-fitting 2 has been added so as to close the free surface of the insulation and prevent ingress of moisture into the cable.

In spite of this end-fitting being present, in the event of the above-considered accident, the isolation resistance between the cable core and electric network ground drops considerably, down to a value of about one thousand ohms. Such a reduction in insolation resistance gives rise to very considerable disturbance to the transmitted signals.

Figure 2:
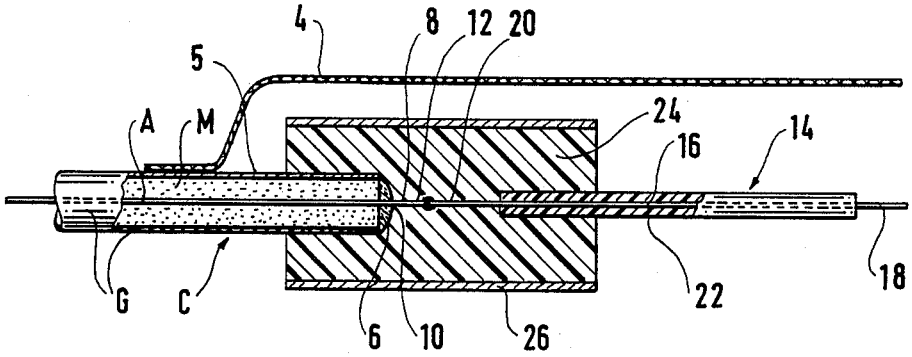
FIG. 2 is an axial section view through an electric cable prepared for connection in accordance with the present invention.

In accordance with the present invention, such disturbance is avoided by preparing the same cable in the manner shown in FIG. 2.

A metal braid 4 or wire for extending the ground connection is welded to the stainless steel sheath G of the cable C.

In the example shown, the cable has a stainless steel sheath, but the invention is equally applicable to a coaxial cable whose outer conductor(s) include a grounded metal braid.

An end length 8 of the cable core A has been bared. This length constitutes the initially-bared length mentioned above. It extends from a rear end 10 to a front end 12.

. A thin first alumina end-fitting 6 is added to the end of the intact portion of the cable in order to close the free surface of the insulating layer.

Further, a connection length 14 is obtained by cutting another cable having organic insulation such as polyethylene which provides good insulation resistance in a humid medium and which constitutes the above-mentioned protective layer 22. The core 16*a* thereof is bared at front and rear ends 18 and 20. Then, the rear end of the core 16 is welded to the front end of the end length 8 of cable core A.

The two cable ends welded together in this way are embedded in a block of thermo-setting resin 24 which is in turn surrounded by a stainless steel connection sheath 26. This resin may be of the epoxy type, for example. The diameter of the protective sheath 26 may be 14 mm while the diameter of the sheath G is 2.5 mm.

The above-mentioned protective end-fitting includes both the alumina part 6 and the block 24 which extends over the non-bared length 5 of the cable C.

The front fraction 18 of the core of the length 14 is bared so as to be connectable to an electrical terminal. This terminal is selected for its ability to withstand accident and post-accident conditions. The terminal block may be of the CK type manufactured by the firm Phönix. Under the above-mentioned conditions of accidental operation, the insolation resistance of one end of the cable connected in this manner to a terminal block is greater than 10 Megohoms. That is why the transmitted signals are undisturbed.

Figure 3:
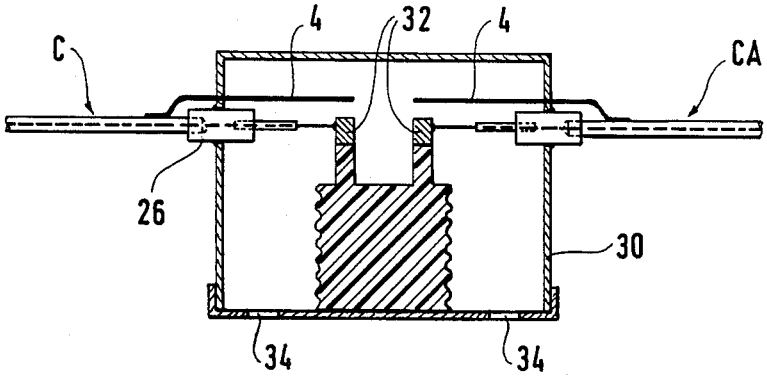
FIG. 3 is a section view through two electric cables connected in a terminal box in accordance with the present invention.

FIG. 3 shows an example of assembly in a box 30 including terminals 32 to which the cores of a cable C and of an identical cable CA are connected. The ground continuity wires or braids 4 are connected to the conductive walls of the box. The connection sheaths such as 26 are used for passing through said walls and are electrically connected thereto.

The box 30 is not sealed: it has ventilation openings 34 which allow vapor to penetrate into the box, however, they also allow condensation droplets from said vapor to escape.

A cable end as prepared in accordance with the invention continues to transmit undisturbed signals in the reactor building of a nuclear power station under all conditions. It also provides such transmission in all conditions with high ambient humidity levels.

We claim:

1. A method of connecting a mineral-insulated electric cable used for transmitting electrical current, in particular in a reactor building of a nuclear boiler, said method being applicable to electrically connecting one end of said cable C to a connection terminal, said cable comprising:

a first metal core A having low electrical resistance in order to provide said transmission with low loss;

an electrically insulating layer M surrounding said first core, said layer being constituted by a divided mineral substance of the type which is able to remain insulating when subjected to service conditions which do not include moisture, but which substance is not moisture proof such that it loses substantial insulating ability in the presence of said moisture unless protected thereagainst;

a sealed protective sheath G surrounding said first core and said layer and an initially bared length 8 of said metal core A extending from a rear end 10 adjacent to the insulating layer, up to a free front end 12;

said method comprising;

surrounding a rear fraction of the initially bared length with an electrically insulating sealed protective end-fitting 10 which extends radially as far as said protective sheath G, thereby preventing moisture pentrating into said insulating layer; and placing at least a front fraction 18 of a second metal cable core in a protective box 30 containing said connection terminal 32 and connecting said fraction to said terminal in order to provide said connection;

preparing a short connection length 14 which comprises:

said second metal core 16 for conducting electricity; and a protective layer 22 surrounding said second core along a central fraction of said length, said protective layer being electrically insulating said moisture proof, and terminating at a distance from the ends of the short connection length, thereby leaving said front fraction 18 and a rear fraction 20 of said second core free; and said method further comprising, after preparing the short connection length, welding the front end 12 of said initially bared length 8 to said rear fraction 20 of the second core of said short connection length;

solidifying a block of resin 24 inside a sealed connection sheath 26 during an end protection operation with said block extending radially beyond said protective sheath G and said protective layer 22, and extending longitudinally from a point on a non-bared length 5 of the cable C up to a point on said protective layer 22 on the short connection length, and surrounding along said length the protective sheath G and the initially bared length 8 of said first core and the rear fraction 20 and protective layer 22 of said connection length.

2. The method according to claim 1, further comprising providing openings (34) in said connection box (30) , thereby equalizing pressure between the inside and the outside thereof and allowing moisture to escape.

3. The method according to claim 1, wherein said protective sheath G of said cable and said connection sheath 26 are made of metal and constitute electrical shielding for forming a coaxial structure for transmitting electrical signals, said box 30 has a wall which is likewise conductive in order to provide shielding, and said method further comprising the steps of passing said connection sheath 26 through said wall of said box 30 and fixing said connection box to said sheath, and providing electrical connections 4 respectively between said wall and said connection sheath 26, and between said protective sheath G of the cable C and said wall.

* * * * *